US010582759B1

(12) United States Patent
Magliulo

(10) Patent No.: US 10,582,759 B1
(45) Date of Patent: Mar. 10, 2020

(54) HOLSTER/PURSE SYSTEM

(71) Applicant: James D. Magliulo, Oldsmar, FL (US)

(72) Inventor: James D. Magliulo, Oldsmar, FL (US)

( * ) Notice: Subject to any disclaimer, the term of this patent is extended or adjusted under 35 U.S.C. 154(b) by 0 days.

(21) Appl. No.: 15/377,542

(22) Filed: Dec. 13, 2016

Related U.S. Application Data

(60) Provisional application No. 62/267,055, filed on Dec. 14, 2015.

(51) Int. Cl.
*A45F 5/00* (2006.01)
*A45F 5/02* (2006.01)

(52) U.S. Cl.
CPC ..... *A45F 5/021* (2013.01); *A45F 2005/002* (2013.01); *A45F 2005/008* (2013.01)

(58) Field of Classification Search
CPC ..... A45F 5/021; A45F 2005/002; A45F 2200/0591; A45F 2005/008; A45F 2003/006; A45F 3/047; A45F 3/02; A45F 2200/0575; A45F 3/14; A45F 5/00; F41C 33/0218; F41C 33/0209; F41C 33/02; A45C 1/04; A45C 3/06; Y10S 224/904
USPC ..... 224/661, 192, 193, 236, 238, 243, 911, 224/931; 150/152, 114
See application file for complete search history.

(56) References Cited

U.S. PATENT DOCUMENTS 5,409,153 A * 4/1995 Ristich ..... A45C 1/04 150/112
5,445,303 A * 8/1995 Cawile, Jr. ..... A45F 5/00 224/222
5,829,653 A * 11/1998 Kaiser ..... A45F 4/02 224/577
5,829,657 A * 11/1998 Romer, Jr. ..... A45C 13/42 224/610
6,446,852 B1 * 9/2002 Sorensen ..... A45F 3/14 224/236
2012/0152995 A1 * 6/2012 Wilson ..... A45F 3/005 224/587

* cited by examiner

*Primary Examiner* — Justin M Larson
*Assistant Examiner* — Matthew T Theis
(74) *Attorney, Agent, or Firm* — Michael J Colitz

(57) ABSTRACT

A primary sheet has an upper section and a lower section and a fold line there between. The lower section has a lower periphery featuring a horizontal upper edge, a horizontal lower edge, a forward edge, and a rearward edge whereby the lower section creates the peripheral appearance of a holster. A large pocket is formed of an inner secondary sheet and an outer secondary sheet. The secondary sheets have a secondary periphery the same as the periphery of the lower section of the primary sheet. A small, pocket is formed of a tertiary sheet peripherally stitched to the outer secondary sheet of the large pocket along the lower edge, the forward edge, and the rearward edge. The small pocket has a free upper edge spaced below the fold line.

1 Claim, 2 Drawing Sheets

FIG. 1
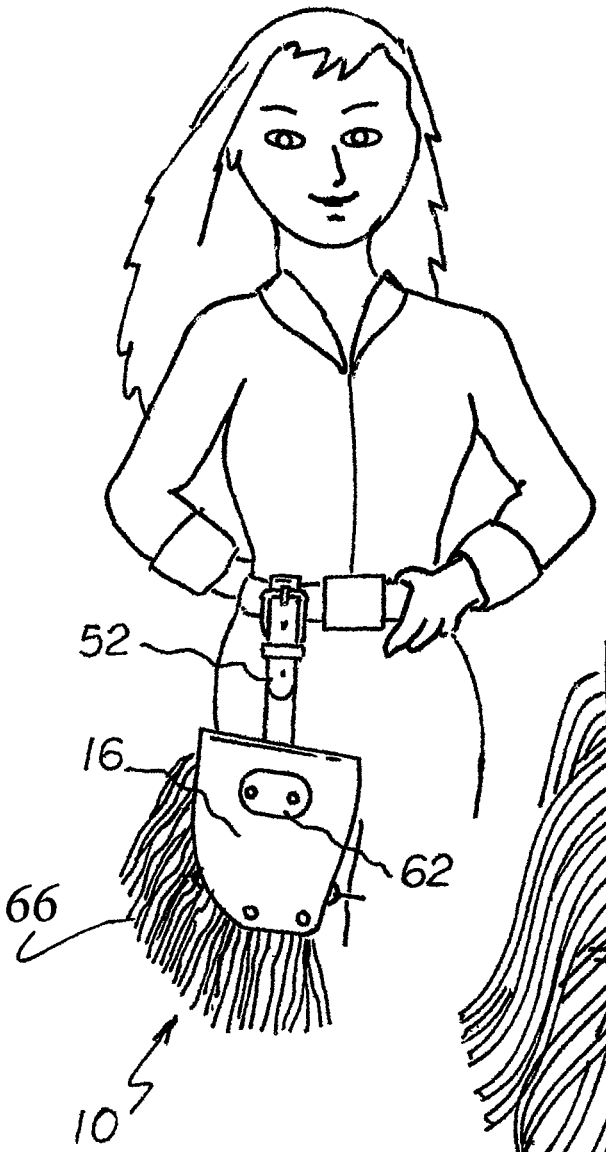
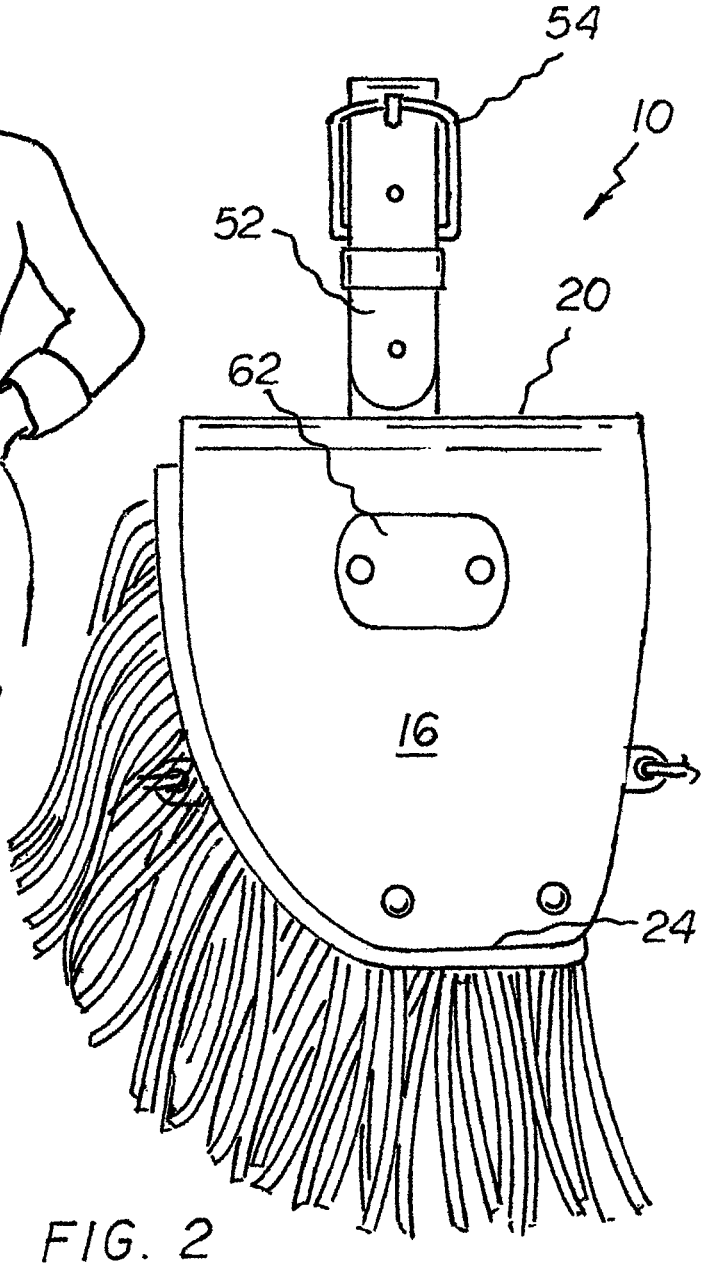
FIG. 2

HOLSTER/PURSE SYSTEM

RELATED APPLICATION

The present application is based upon Provisional Application No. 62/267,055 filed Dec. 14, 2015, the subject matter of which is incorporated herein by reference and the priority of which is hereby claimed.

BACKGROUND OF THE INVENTION

Field of the Invention

The present invention relates to a holster/purse system and more particularly pertains to carrying personal items including a wallet, keys, cigarettes, and the like while creating an appearance of a holster, the carrying of personal items and the appearance of a holster being done in a safe, eye-appealing, convenient, and economical manner.

Description of the Prior Art

The use of purse systems of known designs and configurations is known in the prior art. More specifically, purse systems of known designs and configurations previously devised and utilized for the purpose of carrying personal items are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a holster/purse system that allows carrying personal items including a wallet, keys, cigarettes, and the like while creating an appearance of a holster, the carrying of personal items and the appearance of a holster being done in a safe, eye-appealing, convenient, and economical manner.

In this respect, the holster/purse system according to the present invention substantially departs from the conventional concepts and designs of the prior art, and in doing so provides an apparatus primarily developed for the purpose of carrying personal items including a wallet, keys, cigarettes, and the like while creating an appearance of a holster, the carrying of personal items and the appearance of a holster being done in a safe, eye-appealing, convenient, and economical manner.

Therefore, it can be appreciated that there exists a continuing need for a new and improved holster/purse system which can be used for carrying personal items including a wallet, keys, cigarettes, and the like while creating an appearance of a holster, the carrying of personal items and the appearance of a holster being done in a safe, eye-appealing, convenient, and economical manner. In this regard, the present invention substantially fulfills this need.

SUMMARY OF THE INVENTION

In view of the disadvantages inherent in the known types of holster systems of known designs and configurations now present in the prior art, the present invention provides an improved holster/purse system. As such, the general purpose of the present invention, which will be described subsequently in greater detail, is to carrying personal items including a wallet, keys, cigarettes, and the like while creating an appearance of a holster, the carrying of personal items and the appearance of a holster being done in a safe, eye-appealing, convenient, and economical manner.

To attain this, from a broad perspective, the present invention essentially comprises a primary sheet having an upper section and a lower section and a fold line there between. The lower section has a lower periphery featuring a horizontal upper edge, a horizontal lower edge, a forward edge, and a rearward edge whereby the lower section creates the peripheral appearance of a holster. A large pocket is formed of an inner secondary sheet and an outer secondary sheet. The secondary sheets have a secondary periphery the same as the periphery of the lower section of the primary sheet. A small pocket is formed of a tertiary sheet peripherally stitched to the outer secondary sheet of the large pocket along the lower edge, the forward edge, and the rearward edge. The small pocket has a free upper edge spaced below the fold line.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved holster/purse system which has all of the advantages of the prior art purse systems of known designs and configurations and none of the disadvantages.

It is another object of the present invention to provide a new and improved holster/purse system which may be easily and efficiently manufactured and marketed.

It is a further object of the present invention to provide a new and improved holster/purse system which is of durable and reliable constructions.

An even further object of the present invention is to provide a new and improved holster/purse system which is susceptible of a low cost of manufacture with regard to both materials and labor, and which accordingly is then susceptible of low prices of sale to the consuming public, thereby making such holster/purse system economically available to the buying public.

Lastly, even still another object of the present invention is to provide a holster/purse system for carrying personal items including a wallet, keys, cigarettes, and the like while creating an appearance of a holster, the carrying of personal items and the appearance of a holster being done in a safe, eye-appealing, convenient, and economical manner.

These together with other objects of the invention, along with the various features of novelty which characterize the invention, are pointed out with particularity in the claims annexed to and forming a Part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a holster/purse system constructed in accordance with the principles of the Present invention.

FIG. 2 is a front elevational view of the holster/purse system illustrated in FIG. 1.

The same reference numerals refer to the same parts throughout the various Figures.

DESCRIPTION OF THE PREFERRED EMBODIMENT

Figure 3:
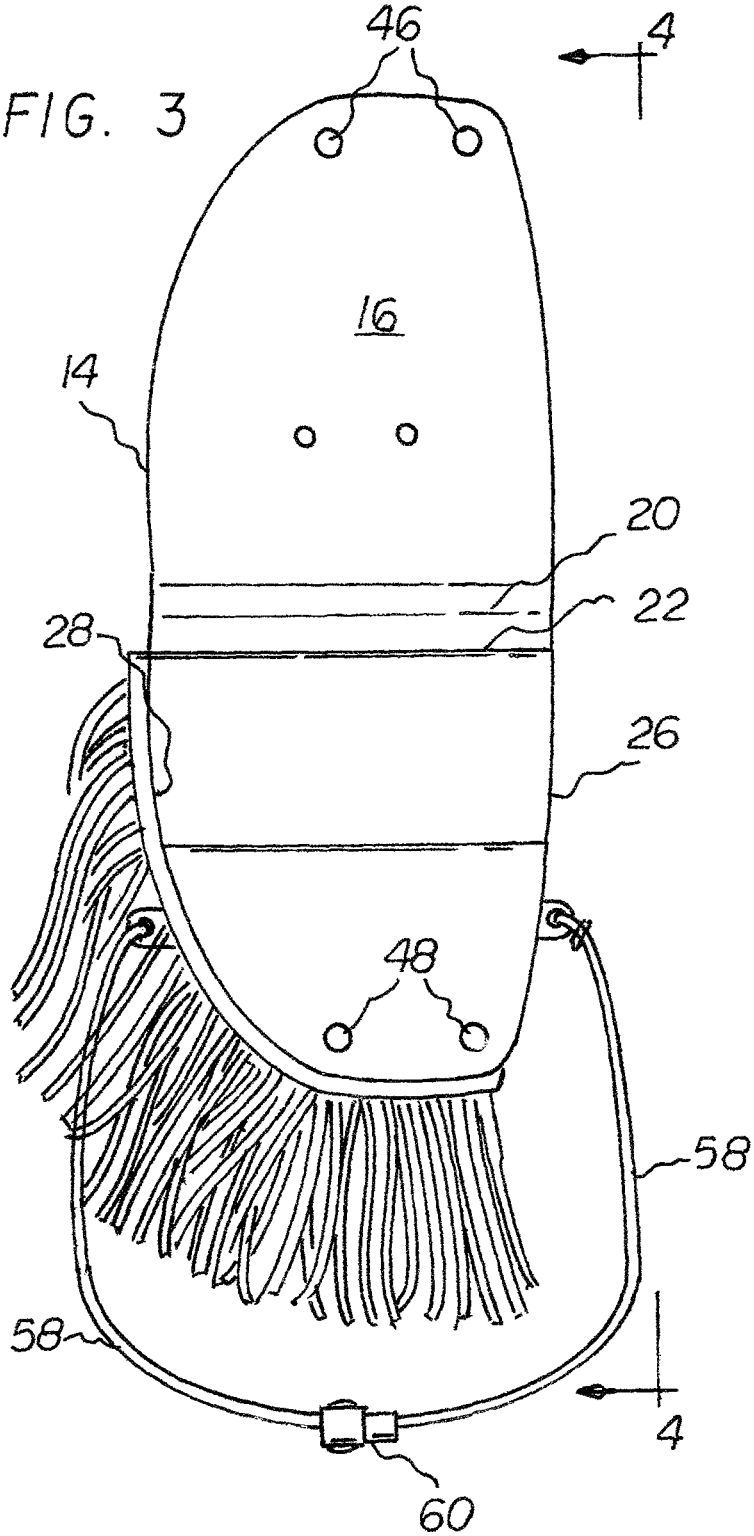
FIG. 3 is a front elevational view similar to FIG. 2 but with the large pocket opened.
Figure 4:
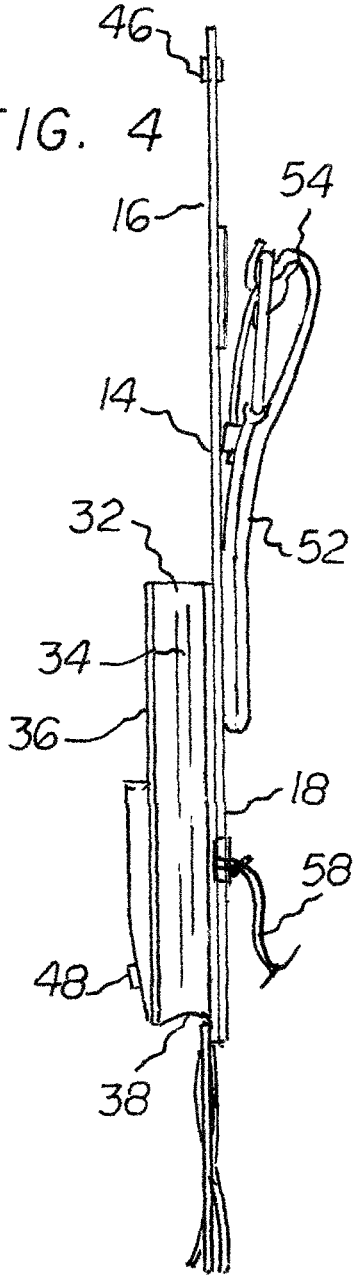
FIG. 4 is a side elevational view taken along line 4-4 of FIG. 3.

With reference now to the drawings, and in particular to FIG. 1 thereof, the preferred embodiment of the new and improved holster/purse system embodying the principles and concepts of the present invention and generally designated by the reference numeral 10 will be described.

The present invention, the holster/purse system 10 is comprised of a plurality of components. Such components in their broadest context include a primary sheet, a large pocket, and a small pocket. Such components are individually configured and correlated with respect to each other so as to attain the desired objective.

From a specific perspective, in the primary embodiment of the holster/purse system 10 of the present invention, a primary sheet 14, an inner secondary sheet 34, and a tertiary sheet 42 are provided.

The primary sheet 14 has an upper section 16, a lower section 18, and a horizontal fold line 20 there between. The lower section has a lower periphery featuring a horizontal upper edge 22, a horizontal lower edge 24, a curved forward edge 26, and a curved rearward edge 28. The curved forward edge has a first radius of curvature and the rearward edge having a second radius of curvature. The first radius of curvature is greater than the second radius of curvature. In this manner, the lower section creates the peripheral appearance of a holster. The upper section has a raised open position above the lower section. The upper section has a lowered closed position overlying the lower section. The upper section has an upper periphery corresponding to and overlying the lower periphery when in the lowered closed position.

Next provided is a large pocket 32. The large pocket is formed of an inner secondary sheet 34 and an outer secondary sheet 36. The inner secondary sheet is peripherally stitched to the primary sheet. The inner secondary sheet and the outer secondary sheet each have a secondary periphery the same as the periphery of the lower section of the primary sheet. An accordion edge 36 peripherally couples the inner secondary sheet and the outer secondary sheet along the lower edge, the forward edge, and the rearward edge.

Next provided is a small pocket. The small pocket is formed of a tertiary sheet 42 peripherally stitched to the outer secondary sheet of the large pocket along the lower edge, the forward edge, and the rearward edge. The small pocket has a free upper edge spaced below the fold line to provide user access to the small pocket.

Next, a pair of upper snaps 46 and a pair of lower snaps 46 are provided. The upper snaps are on the upper section of the primary sheet. The lower snaps are on the tertiary sheet. The upper and lower snaps are adapted to couple together for precluding access to the large pocket and the small pocket.

A support strap 52 with an associated buckle 54 is next provided. The support strap is attached to the primary sheet and is adapted to removably couple to a belt of a user. The buckle is adapted to vary the elevational orientation of the large pocket and small pocket with respect to the user.

Next, a leg strap is provided. The leg strap is formed of two cords 58. The cords have spaced ends attached to the primary sheet. The two cords have a central clip for coupling together the two cords with the Primary sheet to a leg of the user.

A name tag 62 is next provided. The name tag is attached to the upper section of the primary strap. The name tag is for identification purposes.

Lastly provided are a plurality of tassels 66. The tassels depend from the bottom edge and the rearward edge of the primary sheet.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and, described, and accordingly, all suitable modifications and equivalents may be resorted to, falling within the scope of the invention.

What is claimed as being new and desired to be protected by Letters Patent of the United States is as follows:

1. A holster/purse system comprising:

a primary sheet (14) having an upper section (16) and a lower section (18) and a horizontal fold line (20) there between, the lower section having a lower periphery featuring a horizontal upper edge (22) and a horizontal lower edge (24) and a curved forward edge (26) and a curved rearward edge (28), the curved forward edge having a first radius of curvature and the rearward edge having a second radius of curvature, the first radius of curvature being greater than the second radius of curvature whereby the lower section creates the peripheral appearance of a holster, the upper section having a raised open position above the lower section, the upper section having a lowered closed position overlying the lower section, the upper section having an upper periphery corresponding to and overlying the lower periphery when in the lowered closed position;

a first pocket (32) formed of an inner secondary sheet (34) and an outer secondary sheet (36), the inner secondary sheet being peripherally stitched to the primary sheet, the inner secondary sheet and the outer secondary sheet each having a secondary periphery the same as the periphery of the lower section of the primary sheet, an accordion edge (38) peripherally coupling the inner secondary sheet and the outer secondary sheet along the lower edge and the forward edge and the rearward edge;

a second pocket formed of a tertiary sheet (42) peripherally stitched to the outer secondary sheet of the first pocket along the lower edge and forward edge and the rearward edge, the second pocket having a free upper edge spaced below the fold line to provide user access to the second pocket, the first pocket being larger than the second pocket, with the second pocket spaced elevationally beneath the first pocket, the second pocket having a cavity that is generally coextensive with the tertiary sheet and the first pocket between the forward edge and the rearward edge and below the upper edge, the upper edge of the first pocket nearer to the fold and the secondary sheet being nearly half of the size of primary sheet;

a pair of upper snaps (46) on the upper section of the primary sheet and a pair of lower snaps (48) on the tertiary sheet, the upper and lower snaps adapted to couple together for precluding access to the first pocket and the second pocket;

a support strap (52) with an associated buckle (54), the support strap attached to the primary sheet and adapted to removably couple to a belt of a user, the buckle adapted to vary the elevational orientation of the first pocket and second pocket with respect to the user;

a leg strap formed of two cords (58) having spaced ends attached to an intermediate elevational extent of the primary sheet, the two cords having a central clip for coupling together the two cords with the primary sheet to a leg of the user;

a name tag (62) attached to the upper section of the primary strap for identification purposes; and a plurality of tassels (66) depending from the curved forward edge of the primary sheet.

* * * * *